US007175360B2

(12) United States Patent
Zhang

(10) Patent No.: US 7,175,360 B2
(45) Date of Patent: Feb. 13, 2007

(54) TUBE STYLE COSMETIC CONTAINER STRUCTURE

(75) Inventor: Jun Zhang, Taipei County (TW)

(73) Assignee: Chuen Chern Co., Ltd., Jhonghe (TW)

( * ) Notice: Subject to any disclaimer, the term of this patent is extended or adjusted under 35 U.S.C. 154(b) by 56 days.

(21) Appl. No.: 11/046,265

(22) Filed: Jan. 28, 2005

(65) Prior Publication Data

US 2006/0171769 A1 Aug. 3, 2006

(51) Int. Cl.
*B43M 11/06* (2006.01)

(52) U.S. Cl. ..... 401/186; 401/206; 401/263; 401/278

(58) Field of Classification Search ..... 401/186, 401/234, 269, 272, 273, 278, 99, 102, 204–206, 401/232, 263, 270, 279
See application file for complete search history.

(56) References Cited

U.S. PATENT DOCUMENTS 3,256,893 A * 6/1966 McEachran ..... 401/190
3,331,094 A * 7/1967 Schwartzman ..... 401/269
3,400,997 A * 9/1968 Schwartzman ..... 401/186
4,368,746 A * 1/1983 Spatz ..... 401/202
4,984,922 A * 1/1991 Iizuka ..... 401/277

* cited by examiner

*Primary Examiner*—Huyen Le
(74) *Attorney, Agent, or Firm*—Alan D. Kamrath; Nikolai & Mersereau, P.A.

(57) ABSTRACT

A tube style cosmetic container structure includes a tube having an opening arranged axially at one end. An axle sleeve is connected to the tube by being sleeved inside of the opening. A hollow piston rod includes a flanged disk arranged at the outside. A spring is placed against an end surface formed by a holding space of the axle sleeve and the hollow rod piston. A hollow sleeve pipe is firmly sleeved in the snatch part of the hollow piston rod. A hollow pencil pipe is sleeved by the hollow sleeve pipe and snatched by the protruding part of the hollow piston rod. An exterior cap can be screwed on the threaded part at the tube opening. When the exterior cap is screwed on, the material discharge hole can be wholly blocked, and no liquid will flow even if the tube is under certain pressure. When the exterior cap is screwed off and the tube is squeezed to force the contents out, no squeezed contents will backflow even if the pressure is reduced or stopped.

20 Claims, 5 Drawing Sheets

TUBE STYLE COSMETIC CONTAINER STRUCTURE

BACKGROUND OF THE INVENTION

1. Field of the Invention

The present invention relates to a tube style cosmetic container structure and, more particularly, to a cosmetic container that can prevent liquid overflow when its enclosure cap is tightly screwed on, can prevent liquid backflow when its enclosure cap is screwed off for usage, and can not only isolate air pollution, but also ease squeezing by a user.

2. Description of Related Art

For a conventional cosmetic pencil, a user firstly uncaps it before dressing. Then cosmetic liquid is forced to flow out in the direction of the pencil head by holding the pencil rod by one hand, and turning the rotatable handle of the cosmetic pencil by another hand. Thereby, a dressing can be made. Therefore, the cosmetic pencil has to be used in a rotational way that complicates its application, and the cosmetic liquid might be polluted and quality degraded due to contacting air.

According to above description, the known cosmetic pencil has such defects that it is inconvenient to use and is liable to air pollution that affects quality. Therefore, a cosmetic container structure that can wholly eliminate aforementioned defects is made by the inventor according to his years of experience in the development and making of related products, and after careful research and active exploration as well as numerous tests and improvements in light of the problems occurring to the existing cosmetic pencil.

SUMMARY OF THE INVENTION

Thus, the main objective of the invention is to provide a tube style cosmetic container structure that can prevent liquid overflow when its exterior cap is tightly screwed on, can prevent liquid backflow when its exterior cap is screwed off for usage, and can also prevent cosmetic liquid being polluted by air.

In addition, another objective of the invention is to provide a tube style cosmetic container structure that facilitates squeezing by a user and, thus, has advantage in usage.

To achieve the above objectives, the present invention provides a tube style cosmetic container structure.

A tube contains cosmetic liquid and includes an opening arranged axially at one end and a threaded part arranged at the outskirt of the opening.

One end of an axle sleeve is provided with a holding space. A corresponding through material discharge hole is formed at an appropriate place of the outskirt of the other end of the axle sleeve which is connected to the tube by being sleeved at the inside of the opening. A large diameter round hole is concaved in the holding space, and first and second resistant holding surfaces are respectively formed at ends of the round hole. A resistant holding part protrudes circularly at the second holding surface.

Inside of a hollow piston rod, a protruding part is formed at a predetermined position, and a flanged disk is arranged at an appropriate position of the outside of the hollow piston rod. One end of the flanged disk is provided with a snatch part, and a small diameter rod extends from the other end. A spring is placed on the small diameter rod in the axle sleeve and against the end surface formed by the first resistant holding surface. A concave part is circularly formed at an appropriate place between the hollow piston rod and the protruding disk to allow sleeving of an O-ring.

One end of a hollow sleeve pipe is provided with a sleeving part to be firmly sleeved in the snatch part of the hollow piston rod. An opposing surface is formed at the sleeving part of the hollow sleeve pipe, and a cone is formed at the other end of the hollow sleeve pipe.

A hollow pencil pipe is sleeved by the hollow sleeve pipe and snatched by the protruding part of the hollow piston rod. The outskirt of one end of the hollow pencil pipe is provided with a round concave part. A dressing purpose lipstick head is provided on the hollow pencil pipe opposite to the hollow piston rod.

An exterior cap can be screwed on the threaded part at the tube opening. On the exterior cap in correspondence with the threaded part, a snatch part is arranged, and a pressing flange is formed.

When the exterior cap is screwed on, the material discharge hole will be wholly blocked, and no liquid will overflow from the material discharge hole even when the tube is under certain pressure. When the exterior cap is screwed off and the tube is squeezed to force the contents out, no squeezed contents will backflow even when the pressure is reduced or stopped. Thus, the tube can not only be used conveniently but can isolate air pollution and, thus, has advantage in usage.

In the following, other objectives and functions of the invention are further illustrated by describing a preferred embodiment with reference to the drawings and drawing numbers to make the details of the invention apparent to and enable those skilled in the art to implement thereby. The following description to the preferred embodiment is only illustrative and not designed to restrict the range of the invention. Thus, any form of variations or amendments to the invention based on the spirit of the invention are to be embraced within this scope.

BRIEF DESCRIPTION OF THE DRAWINGS

FIG. 4 is an operational view of the tube style cosmetic container when screwed on;

DETAILED DESCRIPTION OF THE INVENTION

Figure 1:
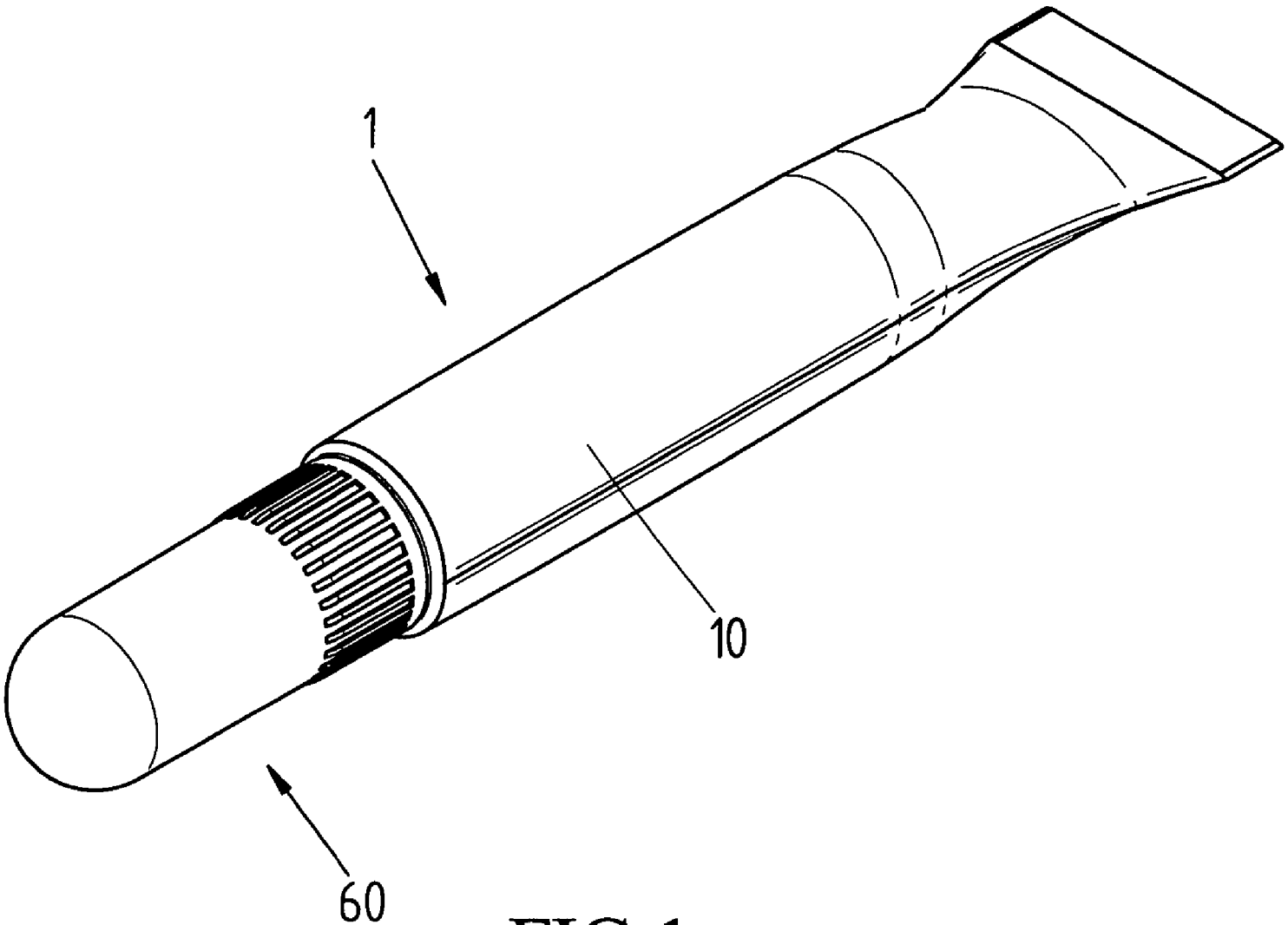
FIG. 1 is a perspective view of a tube style cosmetic container in accordance with the present invention.
Figure 2:
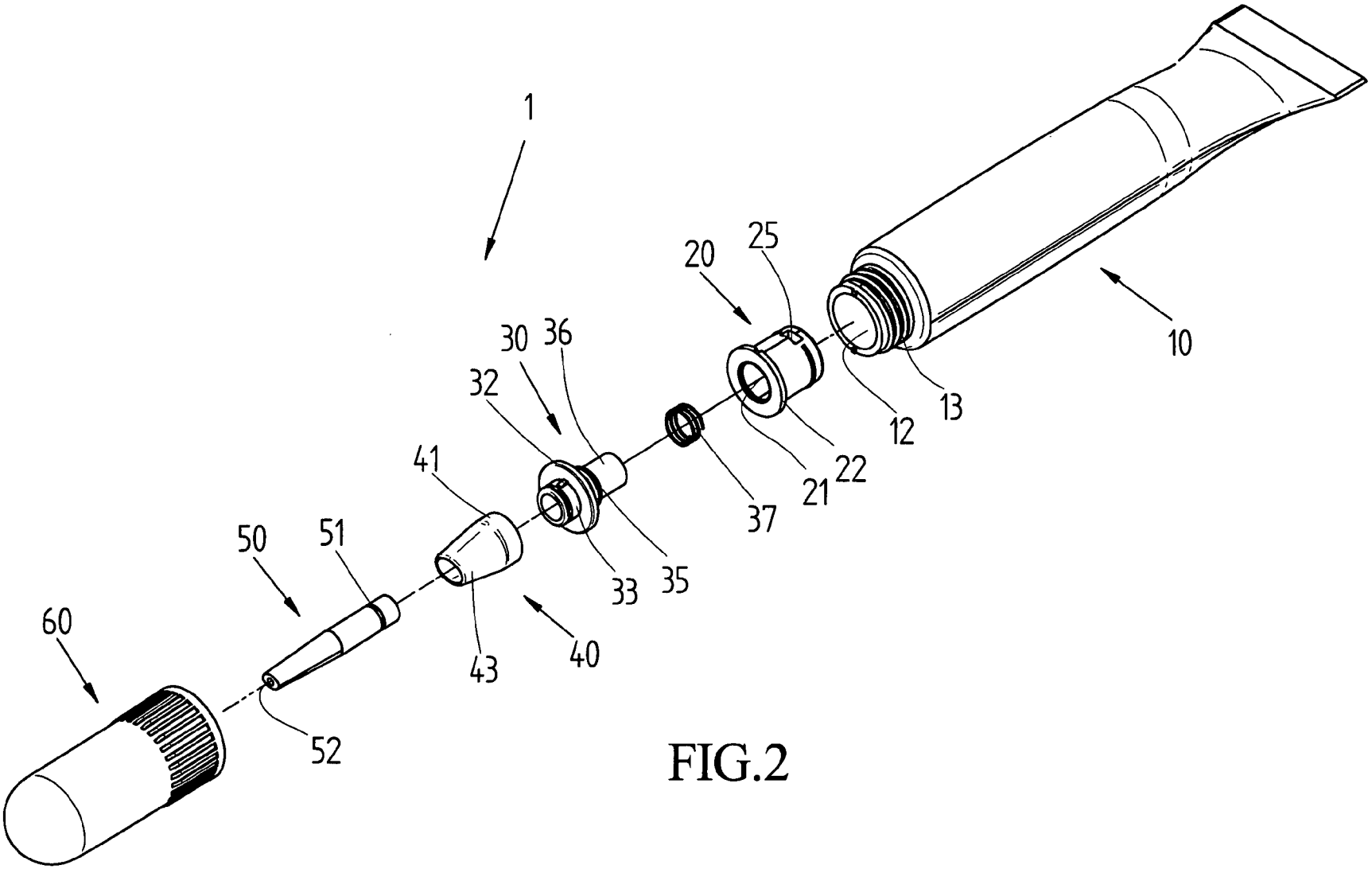
FIG. 2 is an exploded perspective view of the tube style cosmetic container in FIG. 1.
Figure 3:
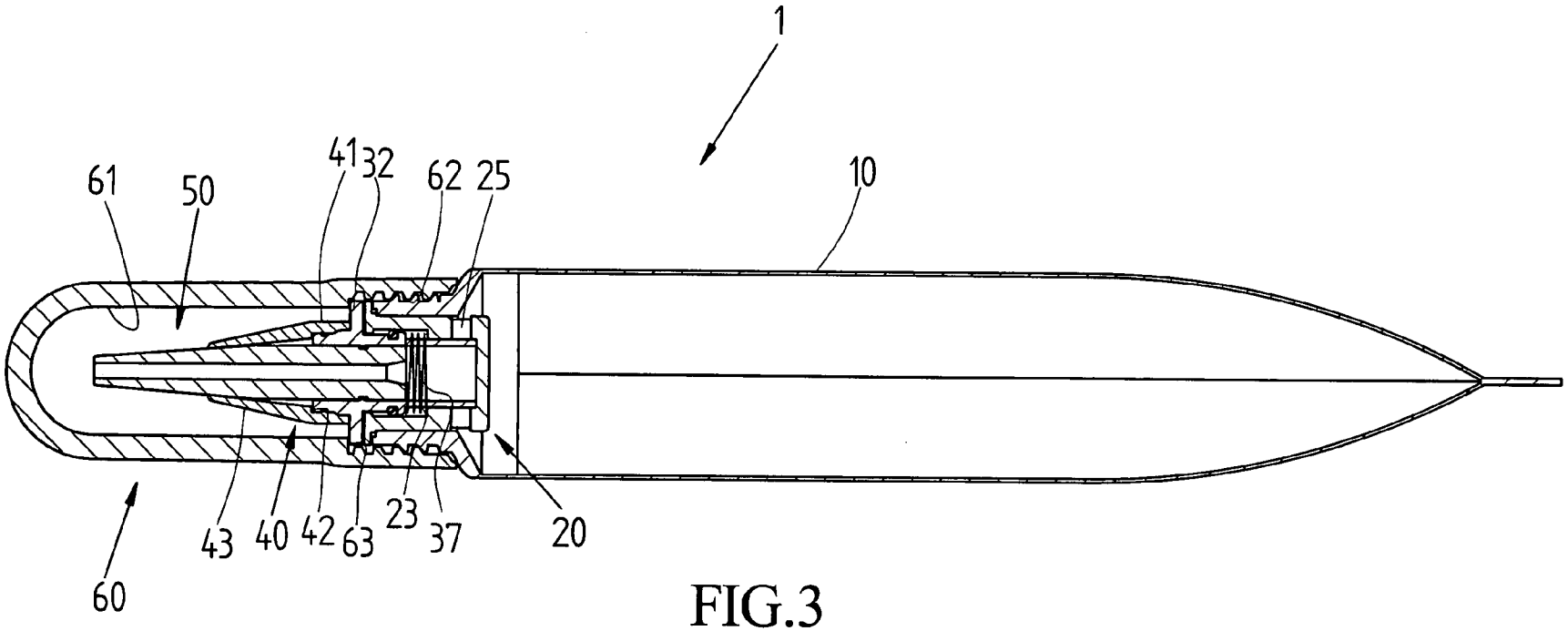
FIG. 3 is a cross-sectional view of the tube style cosmetic container in FIG. 1.

As shown in FIGS. 1–3, the invention is a tube style cosmetic container (1)

A tube (10), in which cosmetic liquid (11) is contained, includes an opening (12) arranged axially at one end. A threaded part (13) is arranged at the outskirt of the opening (12).

One end of an axle sleeve (20) is provided with a holding space (21). A resistant holding part (22) protrudes circularly at an end flange, and the resistant holding part (22) is sleeved at the end flange of the opening (12). In addition, a large diameter round hole (23) is concaved in the holding space (21), and first and second resistant holding surfaces (24) are respectively formed at ends of the round hole (23). At the other end of axle sleeve (20), a corresponding through material discharge hole (25) is formed at an appropriate place of the outskirt, and the material discharge hole (25) is connected to the cosmetic liquid (11) of the tube (10).

Inside of a hollow piston rod (30), a protruding part (31) is formed at a predetermined position. A flanged disk (32) is arranged at an appropriate position of the outskirt of one end of the hollow piston rod (3O). One end of the flanged disk (32) of piston rod (30) is provided with a snatch part (33), and a concave part (34) is circularly formed at the other end to allow sleeving of an O-ring (35). A small diameter rod (36) extends from the end of the concave part (34) so as to sleeve a spring (37). The spring (37) is placed in the holding space (21) against the end surface of the first resistant holding surface (24) and the rod (36).

One end of a hollow sleeve pipe (40) is provided with a sleeving part (41). An opposing surface (42) is formed in the sleeving part (41) so as to sleeve the snatch part (33) of the hollow piston rod (30). A cone (43) is formed at the other end of the hollow sleeve pipe (40).

A round concave part (51) is provided at the outskirt of one end of a hollow pencil pipe (50) to allow the hollow pencil pipe (50) to be sleeved by the hollow sleeve pipe (40) and snatched by the protruding part (31) of the hollow piston rod (30). A through material discharge hole (52) is formed axially at the other end of the hollow pencil pipe (50).

A dressing purpose lipstick head (53) can be held at the material discharge hole (52) of the hollow pencil pipe (50).

An exterior cap (60), which has a containing groove (61), can be screwed on the threaded part (13) at the tube opening (12) of the tube (10). In correspondence with the threaded part (13), a snatch part (62) is arranged, and a pressing flange (63) is formed.

Figure 4:
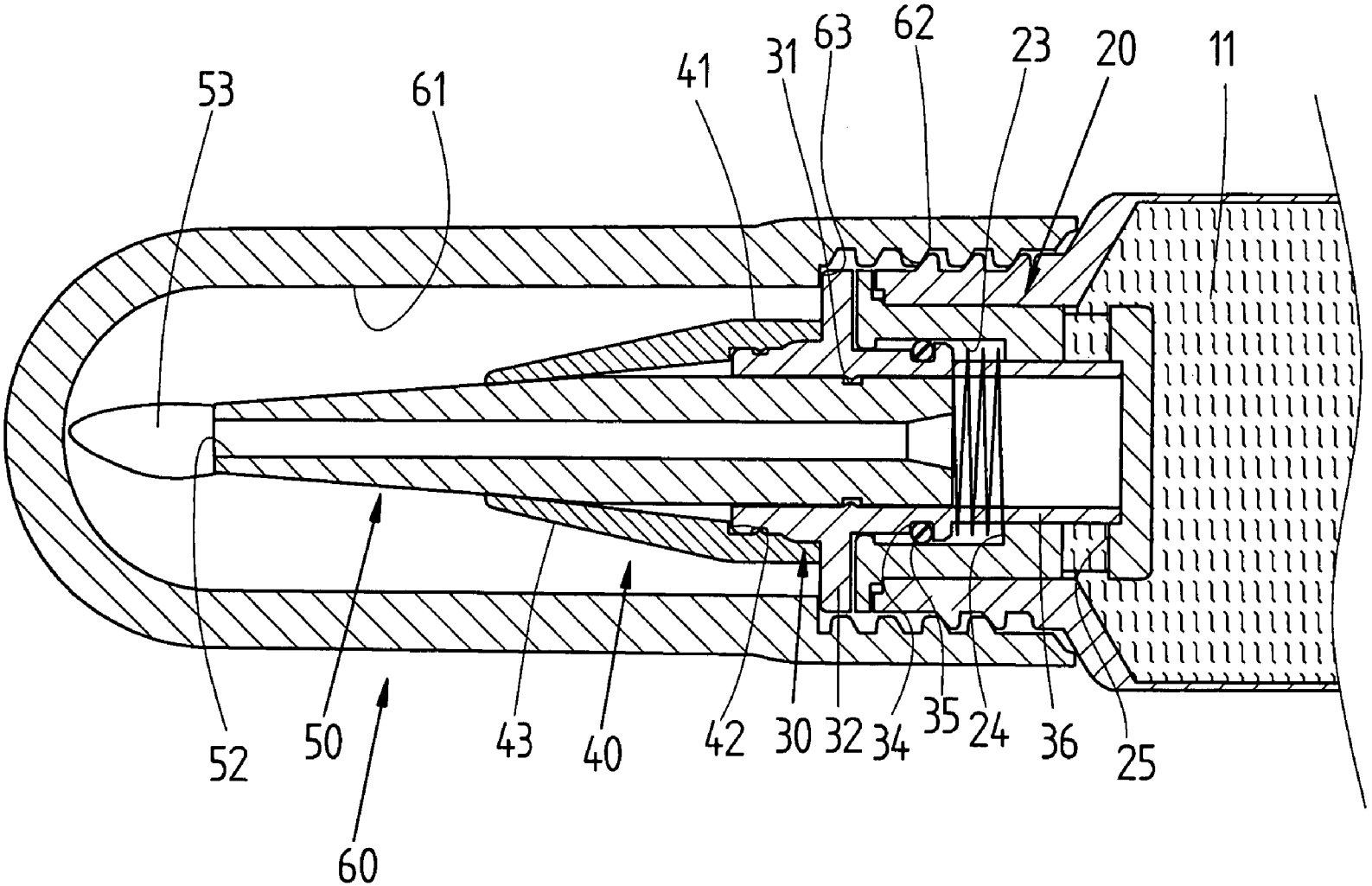
Figure 5:
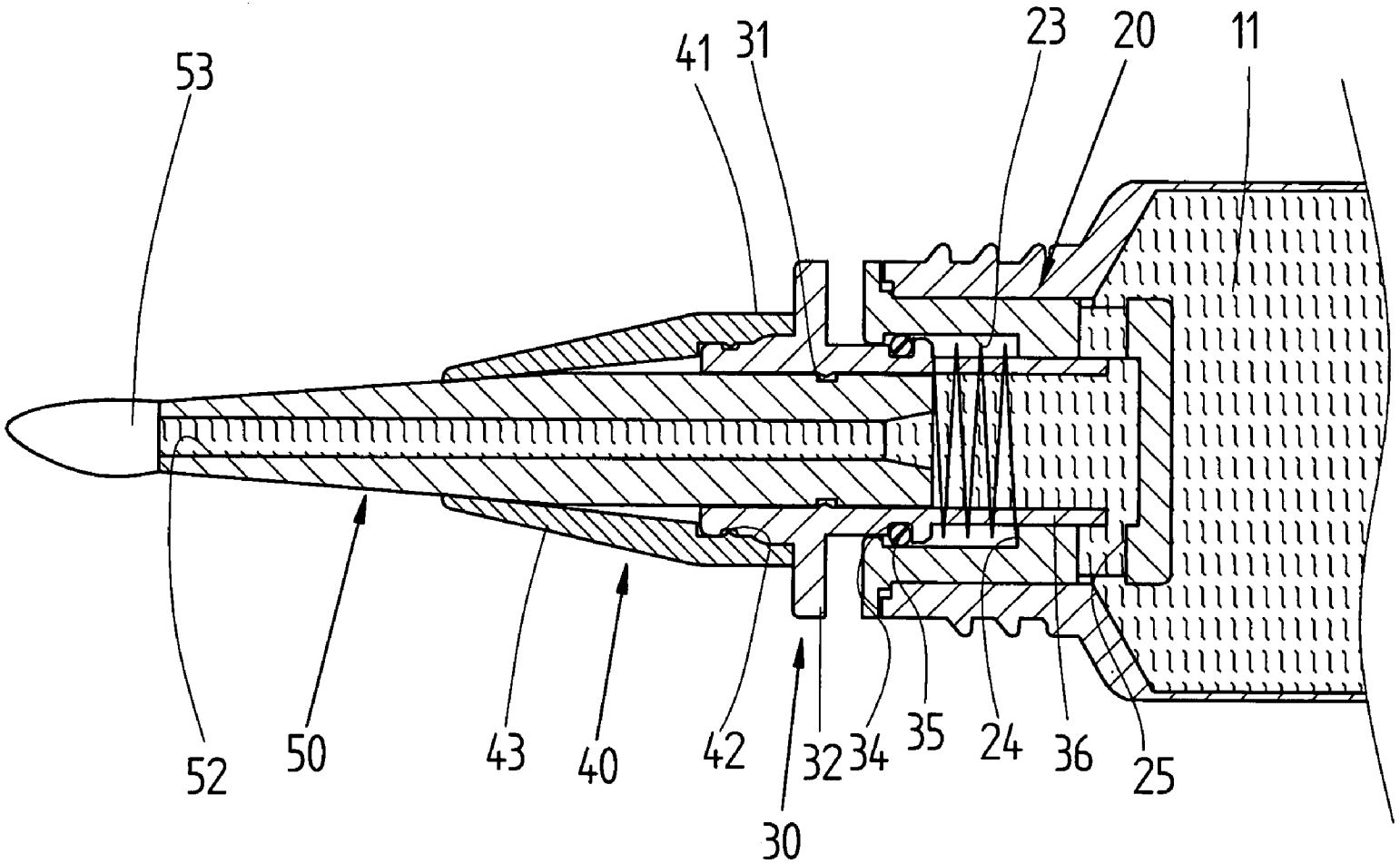
FIG. 5 is an operational view of the tube style cosmetic container when uncapped.

According to above combination, as shown in FIGS. 3–5, and when the tube style cosmetic container (1) is not for use, the exterior cap (60) can be screwed on. At the moment, the flanged disk (32) of the hollow piston rod (30) can be pressed by the pressing flange (63) of the exterior cap (60), enabling the flanged disk (32) to be on the end surface of the resistant holding part (22), and the rod (36) of the hollow piston rod (30) compresses the spring (37). Thus, the rod (36) will move to the bottom of the holding space (21) of the axle sleeve (20) and seal the material discharge hole (25) to prevent the cosmetic liquid (11) in the tube (10) to flow out. Therefore, when the exterior cap (60) is screwed on, the material discharge hole (25) can be wholly blocked, and no liquid will overflow from the material discharge hole (25) even if the tube (10) is under certain pressure.

In addition, using the cosmetic container (1), when the exterior cap (60) is screwed off, the hollow piston rod (30) will move for 1–2 mm under the force of the spring (37). Now, after the tube (10) is squeezed, the cosmetic liquid (11) will flow into the holding space (21) via the material discharge hole (25), then enter into the interior of the hollow piston rod (30), and finally flow out via the material discharge hole (52) of the hollow pencil pipe (50). Therefore, using the action of the hollow piston rod (30) and the spring (37), when the exterior cap (60) is screwed off and the tube (10) is squeezed to force the contents out, no squeezed contents will backflow even if the pressure is reduced or stopped.

In general, the invention has the following advantages:

1) The invention can prevent liquid overflow when the exterior cap (60) is tightly screwed on and can prevent liquid backflow when the exterior cap (60) is screwed off for usage. Thus, the cosmetic container (1) is airtight, so as to prevent the cosmetic liquid (11) from being polluted by air.

2) The tube (10) of the invention is easy to squeeze, and facilitates usage by using the action of the hollow piston rod (30) and the spring (37), as well as the pressing of the exterior cap (60).

Although the invention has been explained in relation to its preferred embodiment, it is to be understood that many other possible modifications and variations can be made without departing from the spirit and scope of the invention as hereinafter claimed.

What is claimed is:

1. A tube style cosmetic container comprising:

a tube having an interior for containing liquid, with the tube having an opening arranged axially at one end;

an axle sleeve connected to the tube by being sleeved at the inside of the opening, with the axle sleeve including a holding space and a through material discharge hole extending between the holding space and the interior of the tube;

a hollow piston rod movably mounted in the holding space of the axle sleeve between an extended position and a retracted position, with the hollow piston rod having a central bore extending from inside of the holding space to outside the holding space, with the hollow piston rod being biased from the retracted position towards the extended position, with the hollow piston rod closing the material discharge hole in the retracted position, with the central bore, the holding space, the material discharge tube being in fluid communication when the hollow piston rod is in the extended position; and an exterior cap removably connected to the tube to enclose the opening, the axle sleeve and the hollow piston rod, with the exterior cap connected to the tube holding the hollow piston rod in the retracted position, with the hollow piston rod moving under bias into the extended position when the enclosure cap is removed from the tube.

2. A tube style cosmetic container as claimed in claim 1, wherein cosmetic liquid is contained in the tube.

3. A tube style cosmetic container as claimed in claim 1, with the hollow piston rod including a flanged disk extending radially outward, with the exterior cap including a pressing flange for abutting with the flanged disk when the enclosure cap is connected to the tube.

4. A tube style cosmetic container as claimed in claim 3, with the axle sleeve including a resistant holding surface located outside of and abutting the opening, with the flanged disk sandwiched between the pressing flange and the resistant holding surface when the enclosure cap is connected to the tube.

5. A tube style cosmetic container as claimed in claim 4, with the tube further including a threaded part arranged around the opening, with the enclosure cap including interior threads for screwing onto the threaded part to removably connect the enclosure cap to the tube.

6. A tube style cosmetic container as claimed in claim 5, further comprising a spring sleeved on the hollow piston rod, with the spring sandwiched between the hollow piston rod and a first holding surface formed in the holding space for biasing the hollow piston rod from the refracted position towards the extended position.

7. A tube style cosmetic container as claimed in claim 6, with the holding space further including a second holding surface axially spaced from the first holding surface, with the hollow piston rod including an outwardly concave part abutting wit the second holding surface in the extended position and spaced from the second holding surface in the retracted position.

8. A tube style cosmetic container as claimed in claim 7, wherein a large diameter round hole is concaved in the holding space, and the first and second resistant holding surfaces are respectively formed at ends of the round hole, wherein a resistant holding part protrudes circularly at the second holding surface.

9. A tube style cosmetic container as claimed in claim 7, wherein the outwardly concave part is circularly formed on the hollow piston rod to allow sleeving of an O-ring.

10. A tube style cosmetic container as claimed in claim 7, further comprising:

a hollow sleeve pipe sleeved partially on the hollow piston rod; and a hollow pencil pipe partially sleeved in the central bore of the hollow piston rod and partially sleeved in the hollow sleeve pipe axially outwardly of the hollow piston rod.

11. A tube style cosmetic container as claimed in claim 10, wherein an opposing surface is formed at a sleeving part of the hollow sleeve pipe receiving the hollow piston rod, and wherein a cone is formed at another end of the hollow sleeve pipe for sleeving on the hollow pencil pipe, with the hollow piston rod including a snatching part for snatching on the opposing surface of the hollow sleeve pipe.

12. A tube style cosmetic container as claimed in claim 10, wherein an outside of one end of the hollow pencil pipe is provided with a inwardly extending round concave part, with the central bore of the hollow piston rod including a protruding part for being snatched by the inwardly extending round concave part.

13. A tube style cosmetic container as claimed in claim 12, wherein a dressing purpose lipstick head is provided on the hollow pencil pipe opposite to the hollow piston rod.

14. A tube style cosmetic container as claimed in claim 10, with the first holding surface being intermediate the through material discharge hole and the second holding surface.

15. A tube style cosmetic container as claimed in claim 1, with the tube further including a threaded part arranged around the opening, with the enclosure cap including interior threads for screwing onto the threaded part to removably connect the enclosure cap to the tube.

16. A tube style cosmetic container as claimed in claim 1, further comprising a spring sleeved on the hollow piston rod, with the spring sandwiched between the hollow piston rod and a first holding surface formed in the holding space for biasing the hollow piston rod from the retracted position towards the extended position.

17. A tube style cosmetic container as claimed in claim 16, with the holding space further including a second holding surface axially spaced from the first holding surface, with the hollow piston rod including an outwardly concave part abutting with the second holding surface in the extended position and spaced from the second holding surface in the retracted position.

18. A tube style cosmetic container as claimed in claim 17, with the first holding surface being intermediate the through material discharge hole and the second holding surface.

19. A tube style cosmetic container as claimed in claim 18, wherein a large diameter round hole is concaved in the holding space, and the first and second resistant holding surfaces are respectively formed at ends of the round hole, wherein a resistant holding part protrudes circularly at the second holding surface.

20. A tube style cosmetic container as claimed in claim 1, further comprising:

a hollow sleeve pipe sleeved partially on the hollow piston rod; and a hollow pencil pipe partially sleeved in the central bore of the hollow piston rod and partially sleeved in the hollow sleeve pipe axially outwardly of the hollow piston rod.

* * * * *